United States Patent [19]

Yamamoto

[11] Patent Number: 4,994,683

[45] Date of Patent: Feb. 19, 1991

[54] STARTER PROTECTIVE DEVICE

[75] Inventor: Kyohei Yamamoto, Hyogo, Japan

[73] Assignee: Mitsubishi Denki Kabushiki Kaisha, Tokyo, Japan

[21] Appl. No.: 328,984

[22] Filed: Mar. 27, 1989

[30] Foreign Application Priority Data

Apr. 1, 1988 [JP] Japan ..... 63-82004

[51] Int. Cl.[5] ..... F02N 11/08

[52] U.S. Cl. ..... 290/31; 219/202; 219/205; 219/494; 219/505; 290/38 C; 123/179 R

[58] Field of Search ..... 219/203-205, 219/201, 202, 491, 494, 492, 497, 499, 501, 505, 506, 508-510; 123/179 H, 179 BG, 179 M, 179 R; 290/31, 35, 38 C, 37, 38 E, DIG. 1, DIG. 3

[56] References Cited

U.S. PATENT DOCUMENTS 4,198,945 4/1980 Eyermann et al. ..... 123/179 H 4,490,620 12/1984 Hansen ..... 123/179 A 4,630,577 12/1986 Cornacchia ..... 123/179 A 4,653,442 3/1987 Swenson ..... 290/38 C 4,696,333 10/1972 Mott ..... 290/38 E 4,873,950 10/1989 Furuyama ..... 123/179 BG

*Primary Examiner*—M. H. Paschall

*Attorney, Agent, or Firm*—Sughrue, Mion, Zinn, Macpeak & Seas

[57] ABSTRACT

In a starter protective device, a sensor detects the operating conditions of the engine, a decision unit having a detecting section for detecting starting conditions and a controlling section for changing, according to the starting conditions provided by the detecting section, reference values for determining whether or not the engine has been started provides a start completion decision output when it is determined from the reference values that the engine is in operation, and in response to the start completion decision output the starter is deenergized, whereby the starter is lengthened in service life.

7 Claims, 2 Drawing Sheets

STARTER PROTECTIVE DEVICE

BACKGROUND OF THE INVENTION

1. Field of the Invention

This invention relates to protective devices for starters (hereinafter referred to as "starter protective devices", when applicable), and more particularly to a starter protective device which automatically stops the starter after the start of the engine.

2. Prior Art

A conventional starter protective device of this type is as shown in FIG. 3. In FIG. 3, reference numeral 1 designates an engine; 2, a starter for starting the engine 1; 3, a battery; 4, a key switch on a vehicle; 5, a decision unit made up of electronic circuits; 6, a sensor for detecting the number of revolutions (speed) of the engine to detect the operating condition of the engine; 7, an electro-magnetic switch which is connected between the starter operating contact 4*a* of the key switch and a current supplying line 8 connected to the starter 2; and 9, a transistor for controlling the on-off operation of the exciting coil 7*a* of the electro-magnetic switch in response to the output of the decision unit 5.

When, in the device thus organized, the key switch 4 is positioned to the contact 4*b*, the decision unit 5 is energized, so that the transistor 9 is rendered conductive (on). Under this condition, the key switch 4 is positioned to the starter operating contact 4*a*, so that current flows from the battery 3 to the exciting coil 7*a*. As a result, the movable contact 7*b* of the electromagnetic switch 7 is brought into contact with the stationary contacts 7*c* and 7*d*, whereby the starter 2 is energized, and the engine 1 is started.

When it is detected by the sensor 6 that the number of revolutions of the engine reaches a predetermined value Ne (FIG. 4), the decision unit 5 operates to render the transistor 9 non-conductive (off), so that the stationary contacts of the electro-magnetic switch 7 are opened; that is, the operation of the starter is suspended.

As was described above, in order to prevent the long time operation of the starter, or its over-run attributing to the engine, with the conventional starter protective device, the operation of the starter is stopped when the decision unit 5 determines that the number of revolution of the engine 1 has exceeded the predetermined value Ne which is the start decision reference. However, the engine may suffer from the following difficulty when operated at cold districts: As shown in FIG. 4, even if the number of revolutions of the engine exceeds the value Ne momentarily, it is decreased as indicated by the dotted line C, so that the engine is stopped. Therefore, in the conventional starter protective device, the time interval (or time lag) $T_L$ which elapses from the time instant A that the number of revolutions exceed the value Ne until the time instant B occurs is employed as another start decision reference, and it is determined whether or not the number of revolutions of the engine exceeds the value Ne over the time interval $T_L$ or at the time instants A and B.

However, the conventional starter protective device is still insufficient in performance; that is, it is impossible for it to determine it positively at all times whether or not the engine has been started. Therefore, with the device, the starter may be stopped before the engine is started. This is because starting an engine depends greatly on the ambient temperature or the conditions of the engine. Thus, it is not suitable that the number of revolutions Ne and the time lag $T_L$ which are constant are employed as the start decision references. This difficulty may be overcome by increasing the number of revolutions Ne and the lag time $T_L$; however, it is not practical to merely do so, because if those data are increased, then in the case when the engine is smoothly started, the starter is energized for a long period of time, or its over-run is caused, with the result that the service life of the starter is decreased as much; that is, the protective device does not work

SUMMARY OF THE INVENTION

Accordingly, an object of this invention is to eliminate the above-described difficulties accompanying a conventional starter protective device.

More specifically, an object of the invention is to provide a starter protective device in which the start decision reference is changed according to the starting conditions of the engine, whereby the engine is started positively, and the long time operation or long time overrun of the starter is prevented.

The foregoing object and other objects of the invention have been achieved by the provision of a protective device for a starter adapted to start engine which, according to the invention, comprises; a sensor for detecting an operating condition of the engine; a decision unit including a detecting section for detecting a starting condition such as the temperature of the engine or the ambient temperature of the engine or the number of times of operation of the starter, and a controlling section for changing, according to the starting condition detected by the detecting section, reference values for determination of the completion of the start of the engine, the decision unit providing a start completion determination output when, in response to an output signal of the sensor, determining by reference to the reference values that the engine is in operation; and interrupting means for interruption the application of current to the starter in response to the start completion determination output provided by the decision unit.

With the device of the invention, when the key switch on the vehicle is turned on to operate the starter, the decision unit reads the ambient temperature from the output of a water temperature sensor or the like, or the temperature of the engine itself, to set engine start determining reference values, and determines whether or not the rotation of the engine is over the reference values thus set according to the engine starting conditions. And when it is determined that the engine has been started, the interrupting means is operated to deenergize the starter.

The nature, principle and utility of the invention will become more apparent from the following detailed description when read in conjunction with the accompanying drawings, in which like parts are designated by like reference numerals or characters.

DETAILED DESCRIPTION OF THE PREFERRED EMBODIMENTS

Figure 3:
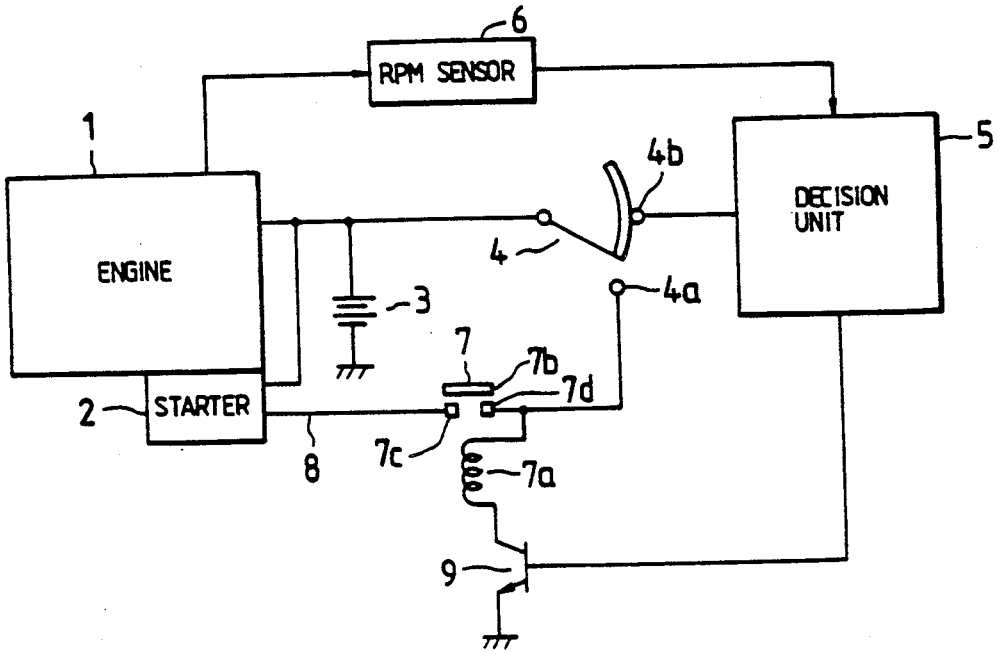
FIG. 3 PRIOR ART
FIG. 3 is a circuit diagram, partly as a block diagram, outlining the arrangement of a conventional starter protective device.
Figure 4:
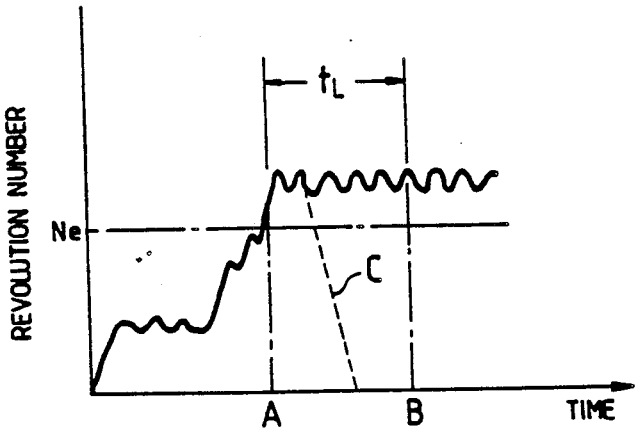
FIG. 4 PRIOR ART
FIG. 4 is a graphical representation indicating engine speed with time for a description of a reference for determining whether or not the engine has been started.

One example of a starter protective device according to this invention will be described with reference to FIG. 1, in which components corresponding functionally to those which have been previously described with reference to FIG. 3 are therefore designated by the same reference numerals or characters.

Figure 1:
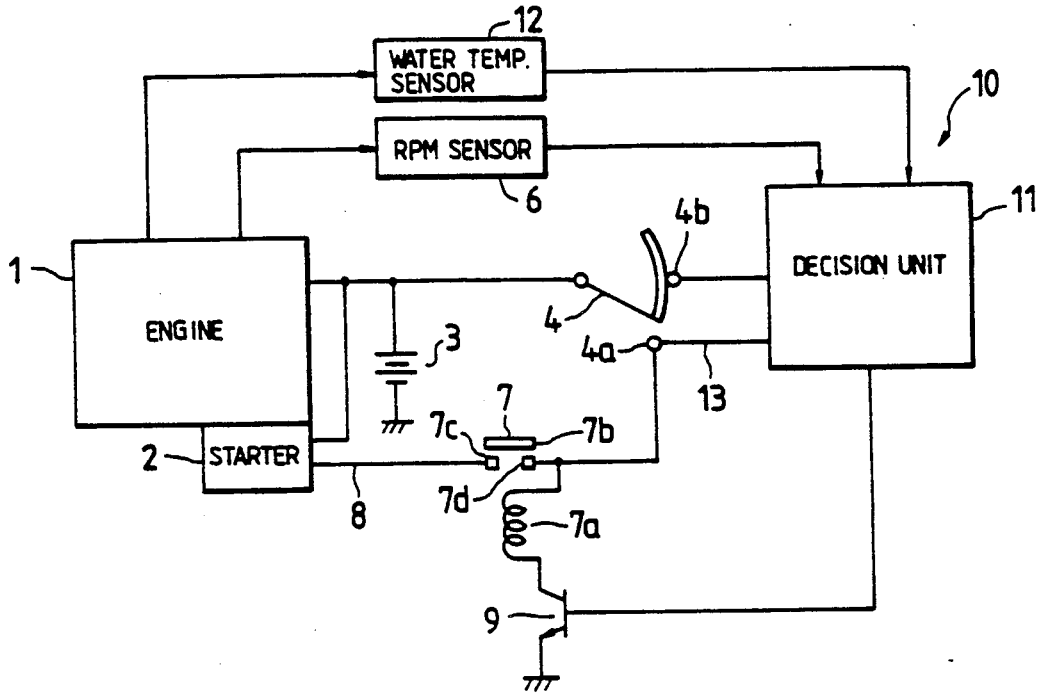
FIG. 1 is a circuit diagram, partly as a block diagram, outlining the arrangement of one example of a starter protective device according to this invention.

As shown in FIG. 1, the starter protective device 10 comprises a decision unit 11 including a detecting section which detects starting conditions, i.e., the temperature of the engine 1 and the number of times of starting operation of the starter 2, and a controlling section which, according to the starting conditions detected by the detecting section, changes reference values for determining whether or not the engine has been started (hereinafter referred to as "engine start determining reference values" when applicable). The detecting section is electrically connected to a water temperature sensor 12 for detecting an engine cooling water temperature in order to input a temperature of the engine 1, and it is connected through a signal line 13 to the starting operating contact 4a of a key switch 4 on the vehicle. Thus, the starting conditions detected by the detecting section are the temperature of the engine 1 itself and the number of times of starting operation. The engine start determining reference values set by the controlling section of the decision unit 11 are the number of revolutions Ne of the engine and a time $T_L$ required for reading the value Ne. These reference values are changed according to the starting conditions.

Figure 2:
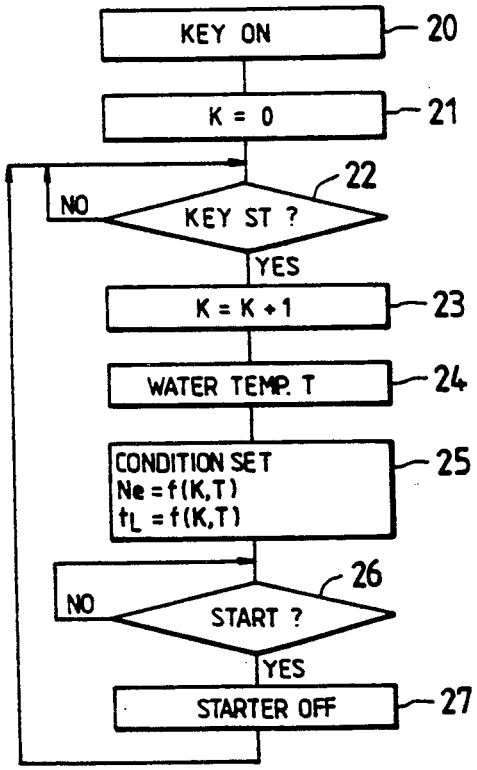
FIG. 2 is a flow chart for a description of the operation of the starter protective device shown in FIG. 1.

The operation of the starter protective device thus constructed will be described with reference to FIG. 2.

When the key switch 4 on the vehicle is turned on (step 20) so as to be positioned to the contact 4b, the power is supplied to the decision unit 11, the number of times of starting operation K is set to zero (K=0) (step 21), and the transistor 9 forming an interrupting circuit is rendered conductive (on), so that the starter protective device is placed in standby state (step 22).

When the key switch 4 is positioned to the starter operating contact 4a, the fact that the starter 2 has been operated is inputted through the signal line 13 to the detecting section of the decision unit 11, and $K=K+1$; that is, K=1 (the first starting operation) is set up (step 23). Thereafter, the engine cooling water temperature T is read by the water temperature sensor 12, and applied to the detecting section of the decision unit 11 (step 24). According to these data, the controlling section sets up the engine start determining reference values of the number of revolution Ne and the time $T_L$ (step 25). More specifically, the data K and T thus obtained are utilized to determine the engine start determining reference values; i.e., the number of revolutions Ne=f (K, T) and the time lag $T_L$=f (K, T) in accordance to predetermined functions. During this operation, the starter 2 is operated, and in the following step 26, it is determined whether or not the engine has been started on these reference values. When it is determined that the engine has been started, the transistor 9 is turned off to open the electromagnetic switch 7, thereby to interrupt the application of current to the starter 2, so that the latter 2 is stopped (Step 27).

If the engine cannot be started, then the key switch 4 is positioned to the contact 4a, so that, in step 22, the result is "yes". Therefore, $K=K+1$ turns out to be "2", and the controlling section changes the reference values; that is, the number of revolutions Ne and the time lag $T_L$ are made larger than in the first engine start determination. The change of the reference values depends on the detected temperature of the engine; therefore, it depends on the seasons when the engine is started; for instance the reference values for cold season, or winter are different from those for warm season, or summer; or it depends on when the engine is started; for instance, when the engine is started immediately after stopped, the reference values are different from ordinary ones. Therefore, in determining the engine starting conditions, it is not always necessary to use the engine cooling water temperature; that is, the ambient temperature of the engine may be used.

In the case where the conditions are not suitable for starting the engine, the engine start determining reference values are changed; that is, the number of revolutions Ne and the time lag $T_L$ are increased so that the engine start is more positively determined; in other words, the operation of stopping the start 2 is not carried out until then.

The above-described embodiment employs the two engine starting conditions; that is, the engine temperature and the number of times of operation of the starter; however, it goes without saying that the engine start can be determined by using only on of the two conditions. However, it should be noted that the use of the two conditions can determine the engine start more positively.

Furthermore, in the embodiment, both of the engine start determining reference values; i.e., the number of revolution Ne and the time lag $T_L$ are changed by the controlling section when necessary; however, the starter protective device may be so designed that one of the reference values is changed. And the change may be carried out gradually or stepwise.

As was described above, in the starter protective device of the invention, the start determining reference values, with which the decision unit determines the completion of start, are changed according to the engine starting conditions, i.e., the engine condition and the number of times of operation of the starter. Therefore, the starter can be started positively and can be improved in durability.

I claim:

1. A protective device for a starter adapted to start an engine, comprising:

sensor means for detecting at least one operating condition of said engine for indicating the start of said engine;

detector means for detecting at least one starting condition of said engine to output a detection signal;

setting means for setting at least one reference level for determination of the completion of the start of said engine wherein said setting means receives said detection signal and said at least one reference level is automatically determined according to said at least one starting condition that corresponds to said at least one reference level;

decision means for comparing an output signal from said sensor means with said at least one reference level to output a start completion signal when said output signal from said sensor means exceeds said at least one reference level; and interruption means for interrupting the operation of said starter in response to said start completion signal.

2. A protective device as claimed in claim 1, wherein said starting condition represents one of the temperature of said engine and the ambient temperature thereof.

3. A protective device as claimed in claim 1, wherein said starting condition represents the number of times of operation of said starter.

4. A protective device as claimed in claim 1, wherein said operating condition represents the number of revolutions of said engine.

5. A protective device as claimed in claim 1, wherein said operation condition represents a time lag required for reading the number of revolutions of said engine.

6. A protective device as claimed in claim 1, wherein said starting conditions are the temperature of said engine and the number of times of operation of said starter.

7. A protection device as claimed in claim 1, wherein said operation conditions are the number of revolutions of said engine and a time lag required for reading the number of revolutions thereof.

* * * * *